US008094867B2

(12) United States Patent
Chang et al.

(10) Patent No.: US 8,094,867 B2
(45) Date of Patent: Jan. 10, 2012

(54) SPEAKER, YOKE THEREOF AND METHOD FOR MANUFACTURING YOKE

(75) Inventors: Jui-Cheng Chang, Taichung (TW); Yen-Shun Peng, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 883 days.

(21) Appl. No.: 12/136,144

(22) Filed: Jun. 10, 2008

(65) Prior Publication Data

US 2009/0304223 A1 Dec. 10, 2009

(51) Int. Cl.
*H04R 1/00* (2006.01)
*H04R 9/06* (2006.01)
*H04R 11/02* (2006.01)

(52) U.S. Cl. ..... 381/412; 381/420

(58) Field of Classification Search ..... 381/396, 381/400, 405, 407, 412, 420
See application file for complete search history.

(56) References Cited

U.S. PATENT DOCUMENTS

2006/0098838 A1* 5/2006 Yoo ..... 381/398
2006/0165246 A1* 7/2006 Lee et al. ..... 381/151

* cited by examiner

*Primary Examiner* — Tuan Nguyen
(74) *Attorney, Agent, or Firm* — Chun-Ming Shih

(57) ABSTRACT

A speaker includes a frame, a diaphragm, a cover, a magnetic device, and a voice coil. The cover and the diaphragm are both disposed on a first side of the frame, and the cover covers the diaphragm. The magnet device is disposed on a second side of the frame. The voice coil is disposed on the magnetic loop generated by the magnetic device and integrated with the diaphragm. The magnetic device includes a yoke, a magnet, and a pole piece. The yoke includes a protrusion by bending for the magnet and the pole piece to be mounted upon.

14 Claims, 7 Drawing Sheets

SPEAKER, YOKE THEREOF AND METHOD FOR MANUFACTURING YOKE

BACKGROUND

1. Field of the Invention

The present invention relates to a yoke of a speaker and a method for making the same, and more particularly, to a yoke of a speaker that has relatively good magnetic coupling and electrical characteristics.

2. Description of Related Art

Referring to FIGS. 1A and 1B, a traditional speaker 1 that is substantially rectangular includes a frame 10, a cover 11, a magnetic device 12, a voice coil 13, and a diaphragm 14. The magnetic device 12, the voice coil 13 and the diaphragm 14 are all disposed between the frame 10 and the cover 11. The magnetic device 12 includes a yoke 121, a magnet 122, and a pole piece 123. The magnet 122 and the pole piece 123 are sequentially mounted on the yoke 121. The voice coil 12 is integrated with the diaphragm 14. A repelling force or an attracting force is generated between the voice coil 13 and the magnet device 12 by the excitation of the magnetic device 12, which drives the diaphragm 14 to vibrate so as to generate a sound transmitted through the cover 11.

A conventional method for making the yoke 121 includes the following steps. A metal plate is first cut into a circular plate. The circular plate is then processed by stamping using a punching machine with a molding pillar. In this way, a protruding pillar 1211 is formed on a central portion of the circular plate. The protruding pillar 1211 enables other components (e.g., the magnet 122 and the pole piece 123) with central through holes to be mounted thereon.

However, the precision of forming the central pillar is generally not good when a noncircular metal plate is used in the stamping process. In addition, the evenness of the noncircular metal plate may not be good because of the different directions of the stresses. Hence, only circular plates are used to make the conventional yokes by stamping at present. Nevertheless, when a circular plate is used to make the yoke, it is required that the shapes of the through holes of the magnet, the pole piece, the voice coil and the frame are circular. When a circle is arranged on a given noncircular area, an area of the circle is limited by the fact that the width (i.e., a diameter of the circle) of the given noncircular area is less than the length of the given noncircular area. Accordingly, an area of a magnet arranged in a noncircular speaker (the speaker shown in FIGS. 1A and 1B is rectangular) can not be large enough. As a result, the electrical characteristic of the speaker is unsatisfactory. In addition, the height of the central protruding pillar is also limited because the yoke is made by stamping. Therefore, magnets with relatively great heights can not be employed in the speaker, which adversely affects the electrical characteristic of the speaker.

It is, therefore, desirable to provide a yoke, a method for making the yoke, and a speaker employing the yoke, with which the area of the magnet is increased so that the electrical characteristic of the speaker is improved.

BRIEF SUMMARY

It is an object of the present invention to provide a speaker with a yoke having a specific shape which can increase magnetic flux and magnetic sensitivity of the speaker, so as to improve the electrical characteristic of the speaker.

According to the above-mentioned object, the speaker according to an embodiment of the present invention includes a frame, a diaphragm, a cover, a magnetic device, and a voice coil. The cover and the diaphragm are both disposed on a first side of the frame, and the cover covers the diaphragm. The magnet device is disposed on a second side of the frame. The voice coil is disposed on the magnetic loop generated by the magnetic device and integrated with the diaphragm. The magnetic device includes a yoke, a magnet, and a pole piece. The yoke includes a protrusion by bending for the magnet and the pole piece to be mounted upon.

A yoke according to another embodiment of the present invention is disposed in a magnetic device of a speaker. The magnetic device includes a magnet and a pole piece. The yoke includes a protrusion formed by bending. The protrusion is configured for enabling the magnet and the pole piece to be mounted thereupon.

A method for making a yoke according to the present invention is provided. The yoke is disposed in magnetic device of a speaker. The method for making the yoke includes the following steps: providing a metal plate, wherein the metal plate has two platforms and a bending portion formed thereon beforehand, the bending portion being between the two platforms; bending the bending portion to form a protrusion protruding away from the two platforms. In addition, a square region can be first cut from each side of the bending portion, and then the bending portion is bent to form the protrusion protruding away from the two platforms.

The protrusion of the yoke used in the speaker according to the present embodiment is bent into form by stamping. Such method does not require the shape of the yoke to be circular, that is, the shape of the yoke can be changed to other shapes depending on the required shape of the speaker. As a result, the yoke can be used in a much wider range. Furthermore, the yoke according to the present invention provides a relatively larger area for the magnet and the pole piece to be mounted upon. Hence, the magnetic flux and the magnetic induction are increased. As a result, the electrical characteristic of the speaker is greatly improved. characteristic Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

A speaker, a yoke used in the speaker, and a method for making the yoke according to a preferred embodiment of the present invention will be described below with reference to the drawings.

Figure 1A:
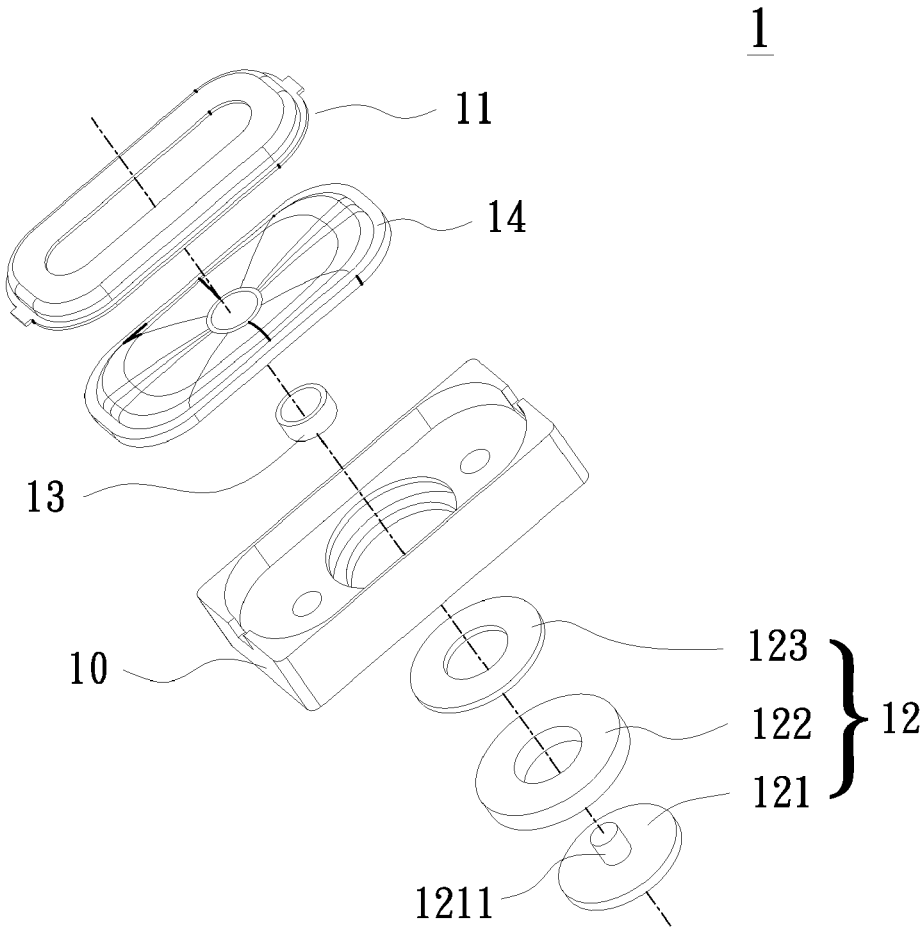
FIG. 1A (prior art)
FIG. 1A is an exploded view of a conventional speaker.
Figure 1B:
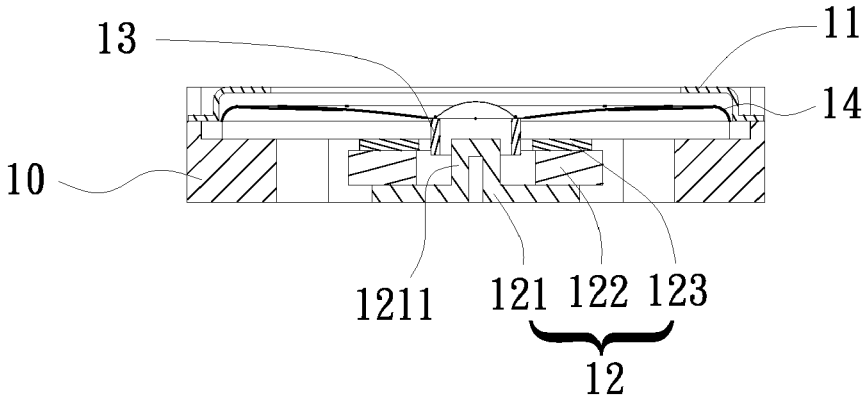
FIG. 1B (prior art)
FIG. 1B is a cross-sectional view of the speaker depicted in FIG. 1A.
Figure 2:
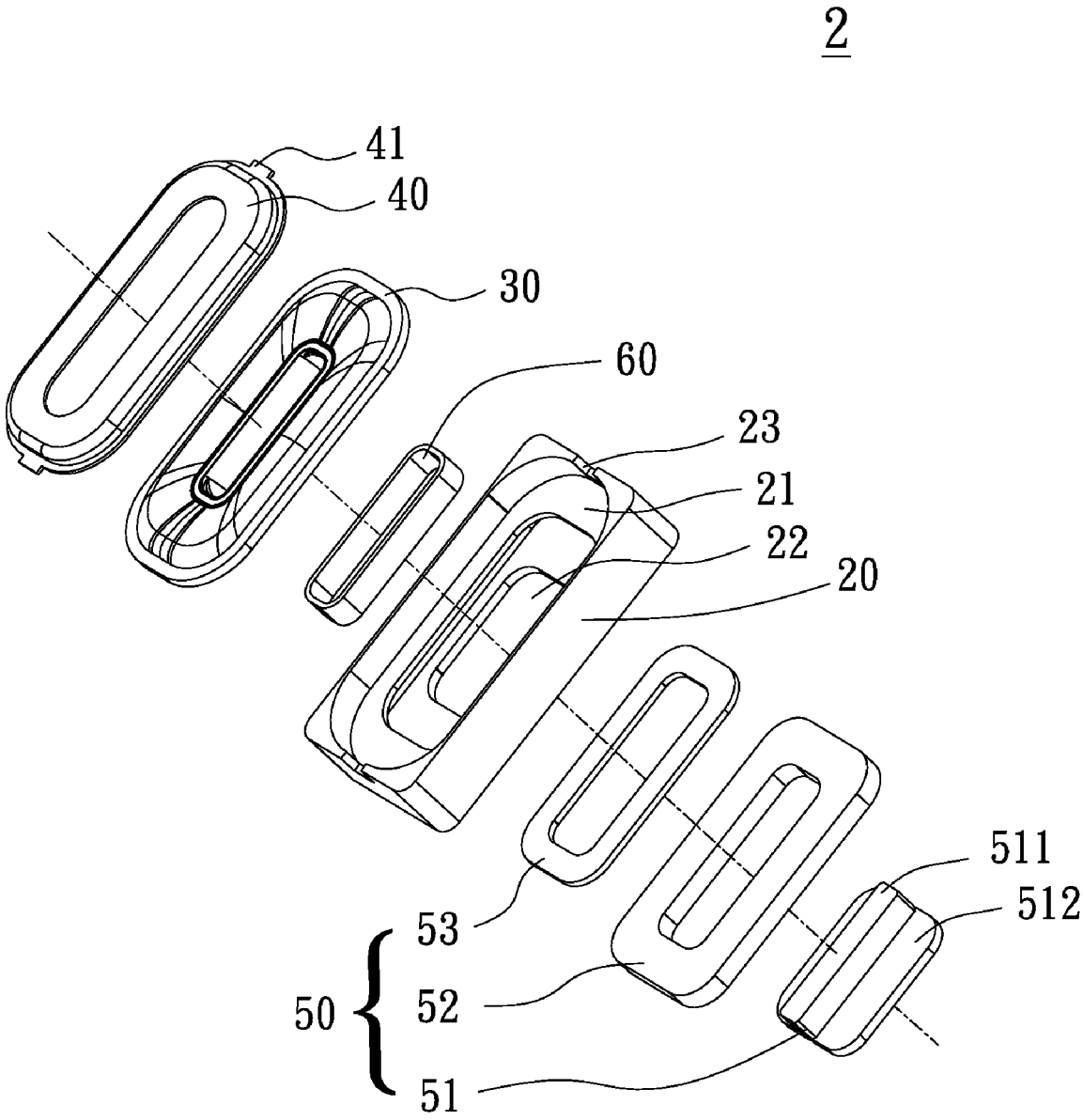
FIG. 2 is an exploded view of a speaker according to a preferred embodiment of the present invention.
Figure 3:
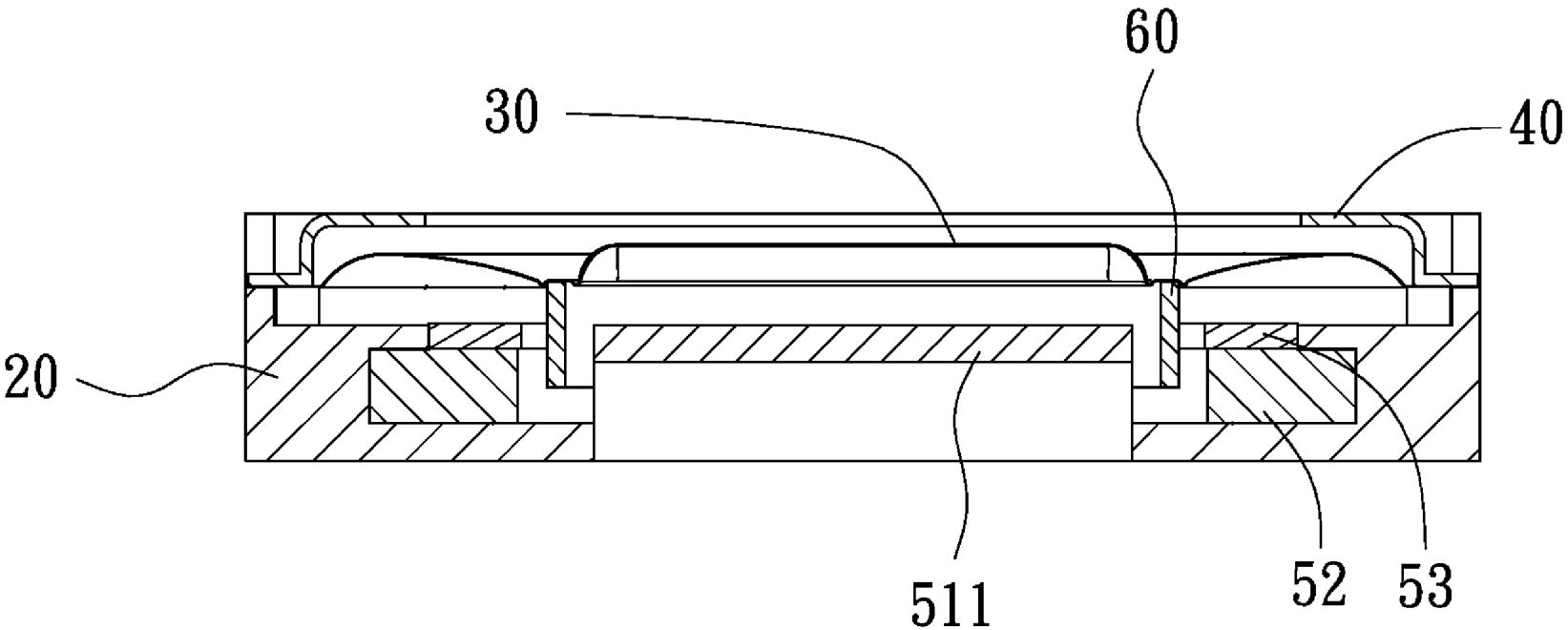
FIG. 3 is a cross-sectional view of the speaker depicted in FIG. 2.

Referring to FIGS. 2 and 3, an exploded perspective view and a cross-sectional view of a speaker according to a preferred embodiment of the present invention are shown. The speaker 2 includes a frame 20, a diaphragm 30, a cover 40, a magnetic device 50, and a voice coil 60. The frame 20 includes a first side and a second side. The diaphragm 30 is disposed on the first side of the frame 20. The cover 40 is disposed on the first side of the frame 20 and covers the diaphragm 30. The magnetic device 50 is disposed on the second side of the frame 20. The voice coil 60 is disposed on the magnetic loop generated by the magnetic device 50 and integrated with the diaphragm 30. When a magnetic change occurs in the magnet device 50, the voice coil 60 is driven to vibrate because of the change of a magnetic force. The voice coil 60 then drives the diaphragm to vibrate, thus generating a sound.

The frame 20 is substantially rectangular. The frame 20 has an elliptical receiving space 21 defined therein. The elliptical receiving space 21 is configured for accommodating the elliptical diaphragm 30. In addition, the frame 20 further includes a through hole 22 defined therein.

The cover 40 is elliptical and includes a latching portion 41 formed on each of two opposite sides. The latching portions 41 are configured for latching corresponding latching slots 23 formed on two opposite sides of the frame 20.

The voice coil 60 is substantially of rectangular ring shape. The voice coil 60 is integrated with the diaphragm 30 in a direction facing the second side of the frame 20. The voice coil 60 is disposed in the through hole 22 of the frame 20.

The magnetic device 50 includes a yoke 51, a magnet 52, and a pole piece 53. The yoke 51 is essentially rectangular. The yoke 51 includes a protrusion 511 and two platforms 512. The protrusion 511 of the yoke 51 has a strip shape. In the present embodiment, the magnet 52 and the pole piece 53 are rectangular so that the magnet 52 and the pole piece 53 can be sequentially mounted on the protrusion 511 of the yoke 51.

The magnet 52 and the pole piece 53 are mounted on the protrusion 511 of the yoke 51 so that the voice coil 60 is positioned between the protrusion 511 and the magnet 52. Such a speaker as the speaker 2 in the present embodiment is generally called an external magnetic speaker.

Figure 4:
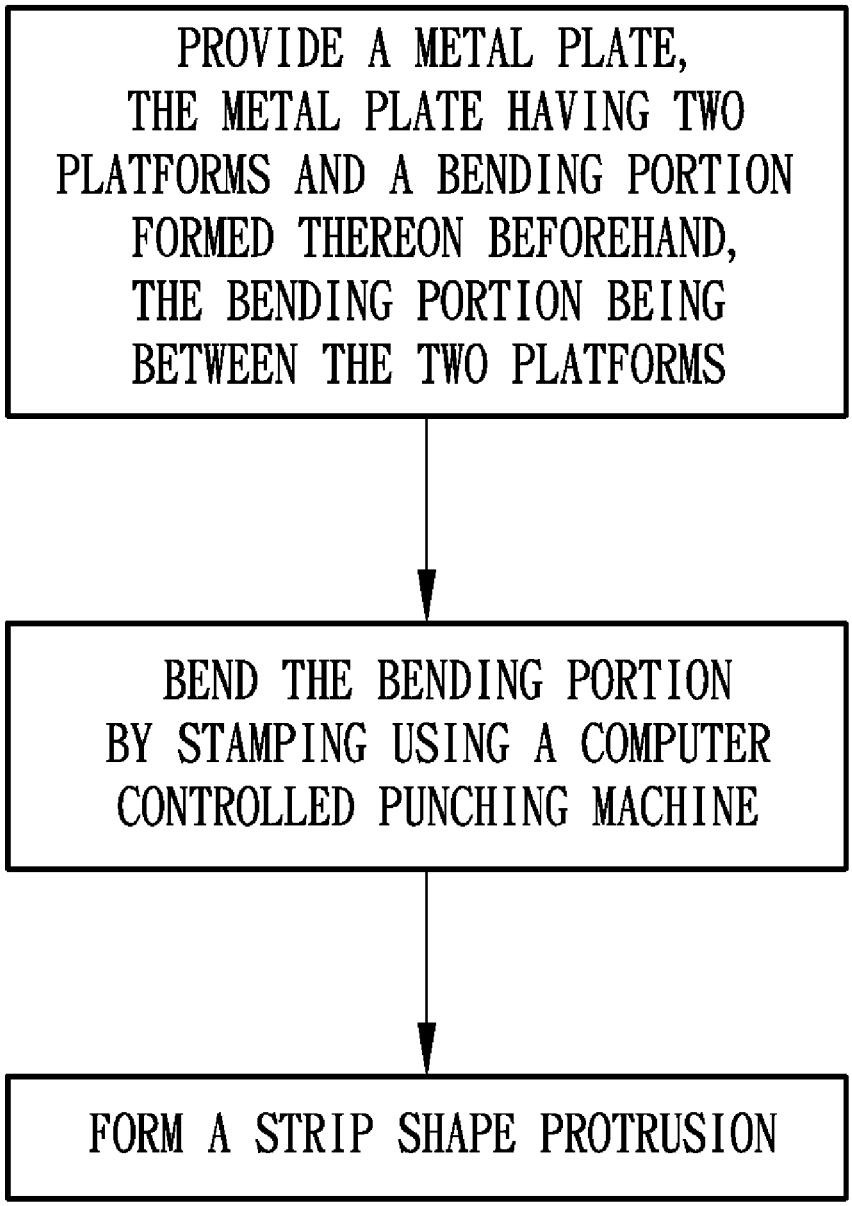
FIG. 4 is a process flow diagram of a preferred embodiment of the method for manufacturing a yoke of a speaker according to the present invention.

In the yoke 51 of the present embodiment, the length of the protrusion 511 is identical with that of the two platforms 512. Referring to FIG. 4, a method for making the yoke 51 is shown. Firstly, a metal plate is provided. The metal plate includes two platforms (i.e., the platforms 512 shown in FIG. 2) and a bending portion formed beforehand. The bending portion is between the two platforms. Secondly, the bending portion is bent by stamping using a computer controller punching machine, thus forming the strip shape protrusion 511 of FIG. 2.

In the present embodiment, the yoke 51 is made in a rectangular shape in order to conform to the rectangular frame 20. However, the shape of the speaker 2 is not limited to a rectangle. According to other design requirements, the shape of the yoke 51 can be changed according to the shape of the frame 20 of the speaker 2, wherein the protrusion 511 is bent to enable the magnet 52 and the pole piece 53 to be mounted thereon. The shape of the yoke 51 can be, for example, a square, a circle, or an ellipse.

Compared with the conventional technology, the yoke 51 of the speaker 2 according to the present invention is bent into form by stamping, so the yoke 51 can be made in a rectangular shape. Accordingly, the magnet 52 and the pole piece 53 can be made in a rectangular shape which cooperatively couple with the yoke 51 to form the magnetic device 50. Compared with the prior art, the area of a rectangle is larger than that of a circle when both of them are arranged on a given noncircular area (because the diameter of the circle is equal to the width of the given noncircular area). Therefore, the magnetic device 50 of the present invention has a better magnetic flux and an improved magnetic induction. As a result, the overall electrical characteristic of the speaker 2 is greatly enhanced.

Figure 5:
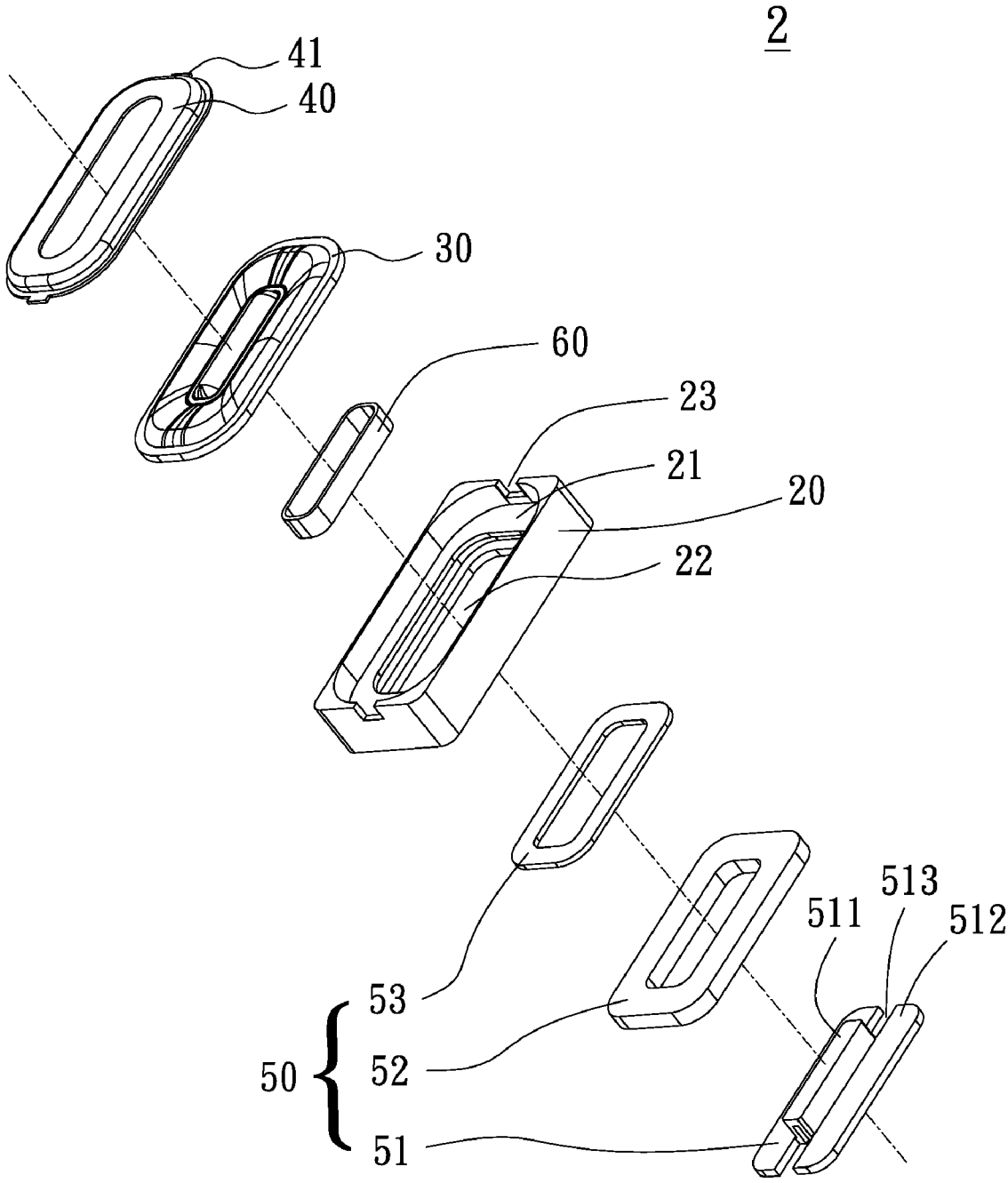
FIG. 5 is an exploded view of a speaker according to another preferred embodiment of the present invention.
Figure 6:
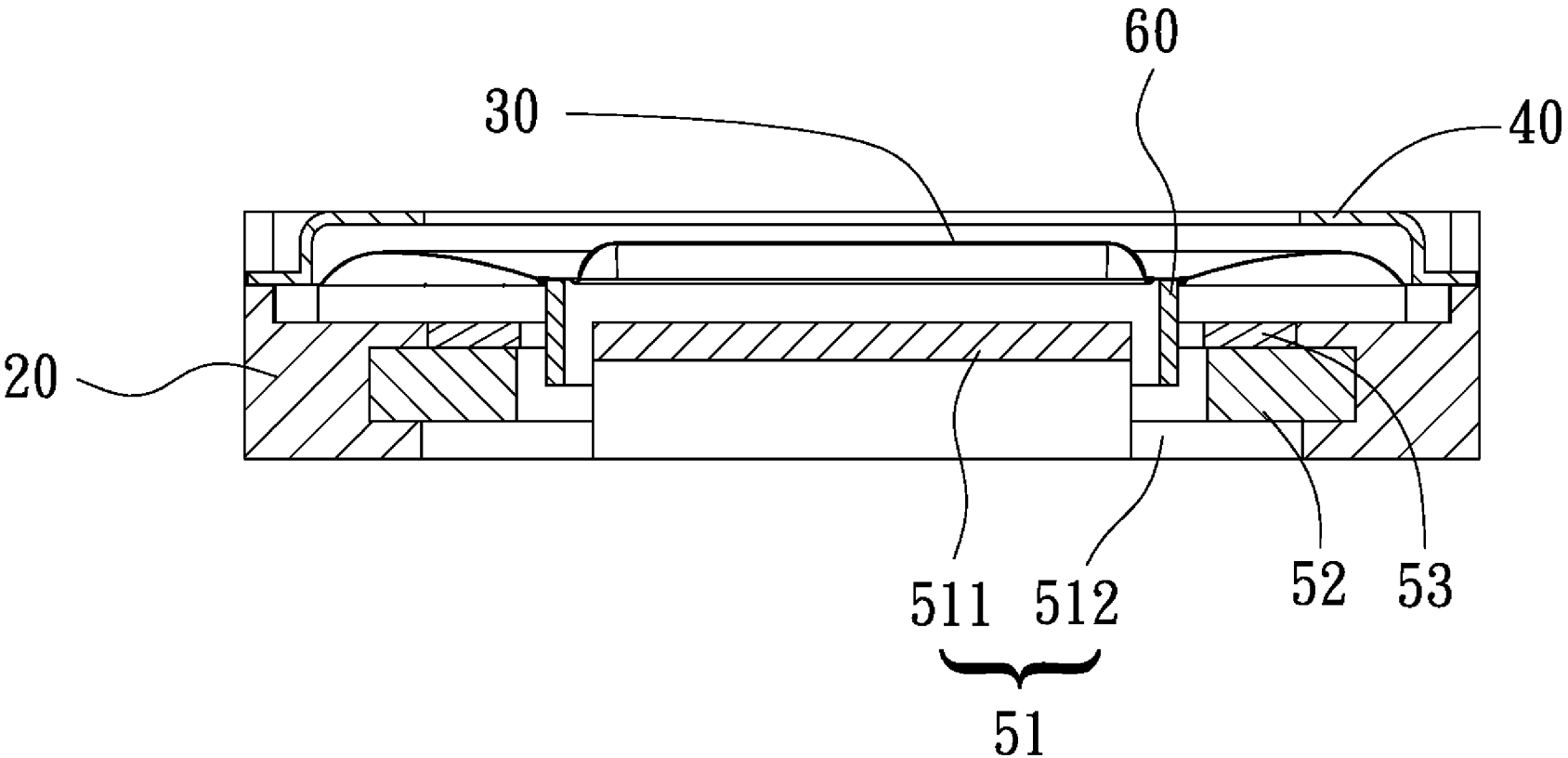
FIG. 6 is a cross-sectional view of the speaker depicted in FIG. 5.
Figure 7:
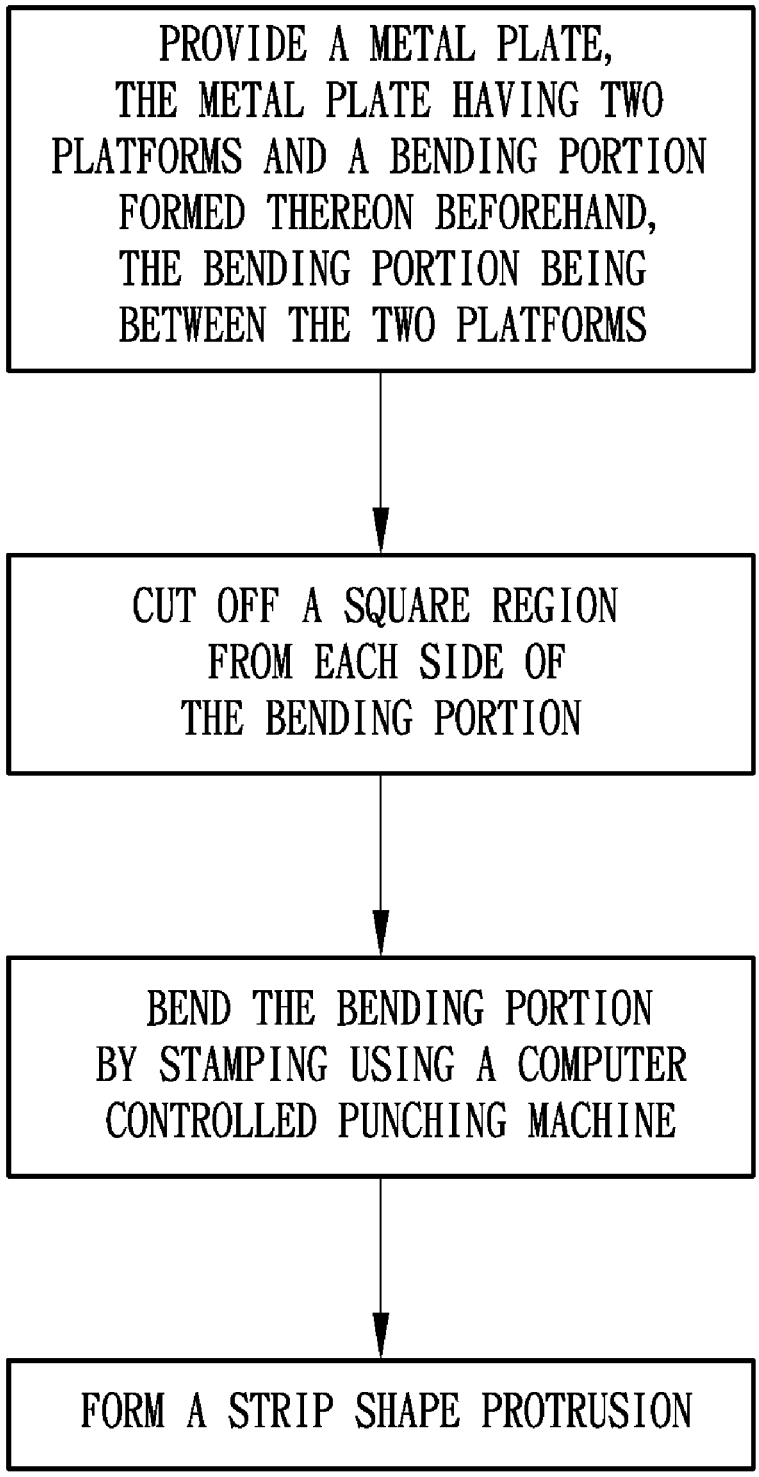
FIG. 7 is a process flow diagram of another preferred embodiment of the method for manufacturing a yoke of a speaker according to the present invention.

Referring to FIGS. 5 and 6, an exploded perspective view and a side cross sectional view of the speaker according to another preferred embodiment are shown. The speaker 2 of the present embodiment mainly differs from that of the above-mentioned embodiment in the shape of the yoke 51. Referring to FIG. 5, the yoke 51 has a gap 513 defined therein on each of two opposite sides, so that the length of the protrusion 511 is less than that of the two platforms 512. Referring to FIG. 6, the difference in lengths allows the magnet 52 to be partly in touch with the two platforms 512 when the magnet 52 is mounted onto the yoke 51. The change in shape of the yoke 51 adds a step in the method for making the yoke 51. Referring to FIG. 7, in the present embodiment, after a metal plate has been provided, a square region is cut off from each side of the bending portion (thus forming the gap 513 shown in FIG. 5). Then the metal plate is bent to form the yoke 51 by stamping so that the length of the protrusion 511 is less than that of the two platforms 512.

In the present embodiment, the protrusion 511 of the yoke 51 shown in FIG. 5 is shorter than that of the yoke 51 shown in FIG. 2, so that an area of the magnet 52 shown in FIG. 5 is less than that of the magnet 52 shown in FIG. 2. Although the area of the magnet 52 is decreased, the electrical characteristic of the overall magnetic device 50 is still improved because the magnet 52 directly contacts the platforms 512 of the yoke 51 so that the loss of the magnetic leakage is decreased. Therefore, the overall sound quality of the speaker 2 is further enhanced.

In addition, the yoke 51 of the present embodiment has the gap 513 defined therein at each side thereof. For some speakers, an exhaust port is necessarily required. When the yoke 51 is used in such a speaker, there is no need to dig any additional holes in the yoke 51. The gas inside the speaker can be exhausted through the gap 513, thus adjusting the pressure inside the speaker. Therefore, the sound quality of the speaker is improved.

In summary, the yoke of the speaker according to the present invention is bent to form the protrusion by stamping. Such a method for manufacturing the yoke does not limit the shape to be circular. That is, the shape of the yoke according to the present embodiment can not only be rectangular as described in the above embodiments, but also be changed to other shapes depending on the required shape of the speaker. As a result, the yoke of course can be used in a wider range. Furthermore, the rectangular yoke as described in the above embodiments provides a relatively larger area to enable the magnet and the pole piece to be mounted upon. Hence, the magnetic flux and the magnetic induction are increased. As a result, the overall electrical characteristic of the speaker is relatively better.

In addition, because the protrusion of the yoke is formed by bending, the height of the protrusion is not limited. Hence the height (i.e., the thickness) of the magnet mounted on the yoke can be increased. In this way, the overall electrical characteristic of the speaker is further improved.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A speaker comprising:

a frame having a first side and a second side;

a diaphragm disposed at the first side of the frame;

a cover disposed at the first side of the frame and covering the diaphragm, a magnetic device disposed at the second side of the frame, the magnetic device comprising a yoke, a magnet, and a pole piece, the yoke having a protrusion by bending for the magnet and the pole piece to be mounted upon; and a voice coil disposed on a magnetic loop generated by the magnetic device and integrated with the diaphragm;

wherein the yoke further comprises two platforms, the protrusion being disposed between the two platforms, the yoke having a gap defined at each of the two opposite sides thereof so that the length of the protrusion is less than the length of the yoke and the magnet is in touch with the two platforms when mounted onto the yoke.

2. The speaker of claim 1, wherein the length of the protrusion is identical with the lengths of the two platforms.

3. The speaker of claim 1, wherein the yoke is made by bending a metal plate.

4. The speaker of claim 3, wherein the metal plate is bent by punching with a computer controlled punching machine.

5. The speaker of claim 1, wherein the yoke has a rectangular shape and the protrusion has a stripe shape.

6. The speaker of claim 5, wherein both the magnet and the pole piece have a rectangular ring shape and are covered on the yoke.

7. The speaker of claim 6, wherein the frame has a rectangular shape and an elliptical receiving space configured for accommodating the cover and the diaphragm.

8. The speaker of claim 7, wherein the frame further has a through hole, the voice coil is disposed through the through hole and the voice coil has a rectangular ring shape.

9. A yoke disposed in a speaker, comprising:

two platforms; and a protrusion formed between the two platforms by a bending process, the protrusion being configured for a magnet of the speaker to be mounted thereon;

wherein the yoke further has a gap defined at each of the two opposite sides thereof so that the length of the protrusion is less than the length of the yoke and the magnet is in touch with the two platforms when mounted onto the yoke.

10. The yoke of claim 9, wherein the speaker further comprises a pole piece, the pole piece being configured for forming a magnetic device along with the magnet and the yoke, the magnetic device being configured for forming a magnetic loop.

11. The yoke of claim 10, wherein the speaker further comprises a voice coil and a diaphragm, the voice coil being disposed on the magnetic loop formed by the magnetic device and integrated with the diaphragm.

12. The yoke of claim 9, wherein the length of the protrusion being identical with the lengths of the two platforms.

13. The yoke of claim 9, wherein the yoke is made by bending a metal plate.

14. The yoke of claim 13, wherein the metal plate is bent by stamping with a computer controlled punching machine.

* * * * *